US006017067A

United States Patent [19]

Yoneyama et al.

[11] Patent Number: 6,017,067

[45] Date of Patent: Jan. 25, 2000

[54] LATCH DEVICE FOR A TAILGATE OF A VEHICLE

[75] Inventors: Fumihiro Yoneyama, Yamanashi-ken; Seiichi Ohtsu, Kanagawa-ken; Nobuhiro Horikiri, Kanagawa-ken; Yoshiaki Takahashi, Kanagawa-ken, all of Japan

[73] Assignees: Mitsui Kinzoku Kogyo Kabushiki Kaisha; Isuzu Motors Limited, both of Tokyo, Japan

[21] Appl. No.: 08/998,813

[22] Filed: Dec. 29, 1997

[30] Foreign Application Priority Data

Dec. 27, 1996 [JP] Japan ..... 8-357558

[51] Int. Cl.[7] ..... E05B 65/19

[52] U.S. Cl. ..... 292/216; 292/DIG. 3; 292/DIG. 29

[58] Field of Search ..... 292/169.12, 169.11, 292/216, 48, DIG. 3, DIG. 23, DIG. 27, DIG. 29; 296/146.8

[56] References Cited

U.S. PATENT DOCUMENTS

| | | | |
|---|---|---|---|
| 2,926,943 | 3/1960 | Leslie . | |
| 3,146,021 | 8/1964 | Ericson . | |
| 3,645,043 | 2/1972 | Velavicius | 49/370 |
| 4,157,844 | 6/1979 | Sarosy | 292/48 |
| 5,035,449 | 7/1991 | Shiratori | 292/48 |
| 5,295,374 | 3/1994 | Bender | 70/208 |

FOREIGN PATENT DOCUMENTS 5-045753 7/1993 Japan .

*Primary Examiner*—Flemming Saether
*Assistant Examiner*—Gary Estremsky
*Attorney, Agent, or Firm*—Browdy and Neimark

[57] ABSTRACT

A latch device on a vehicle tailgate having upper and lower doors comprises an open handle assembly for releasing a lower latch assembly from a lower striker, a key cylinder for releasing an upper latch assembly and an upper striker, a coupling mechanism displaceable between a locked position for disabling an opening operation of the handle assembly and an unlocked position for enabling the opening operation of the handle assembly. The upper latch assembly has a latch and a ratchet. The ratchet is displaceable between an engaging position for engaging with the latch located in a door-closed position and an initial position for making contact with the latch located in a door-open position. The coupling mechanism is displaced to the locked position when the ratchet is in the engaging position and displaced to the unlocked position when the ratchet is in the initial position.

7 Claims, 6 Drawing Sheets

FIG. 3
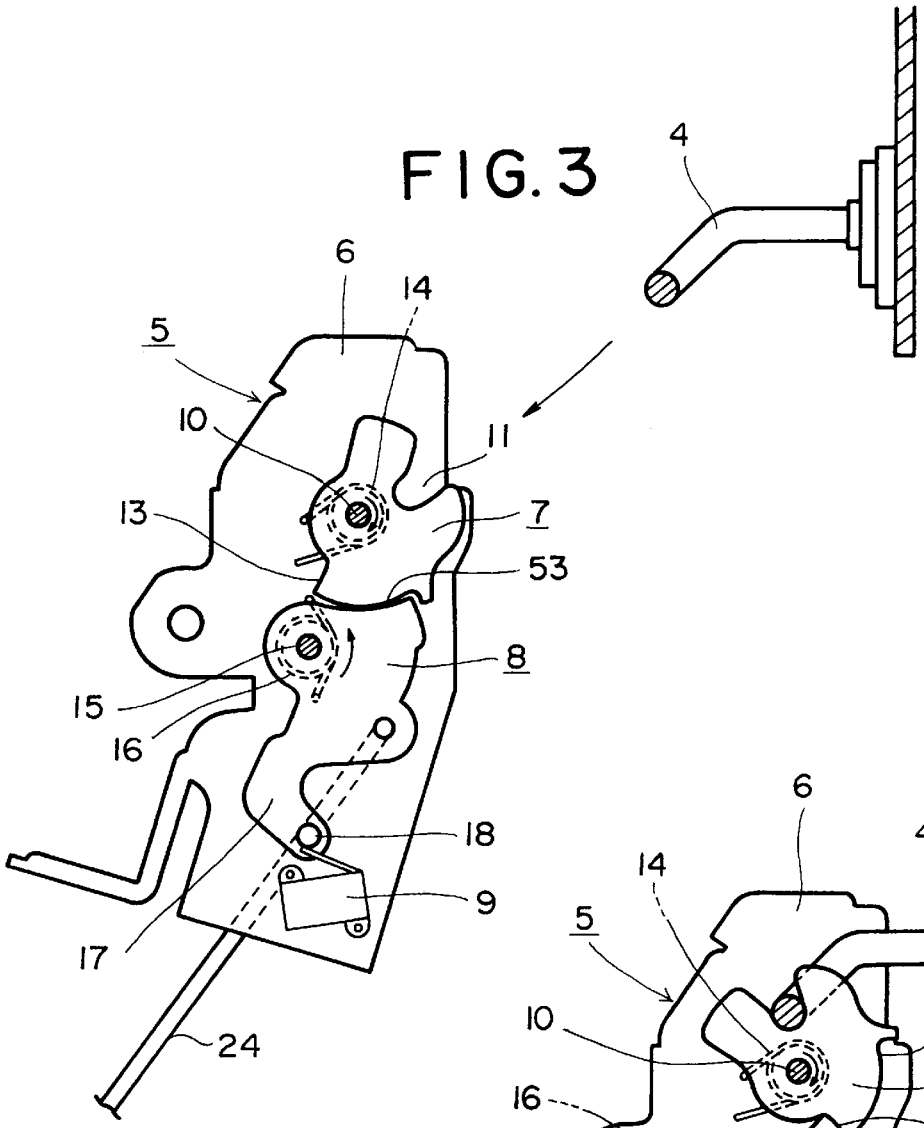
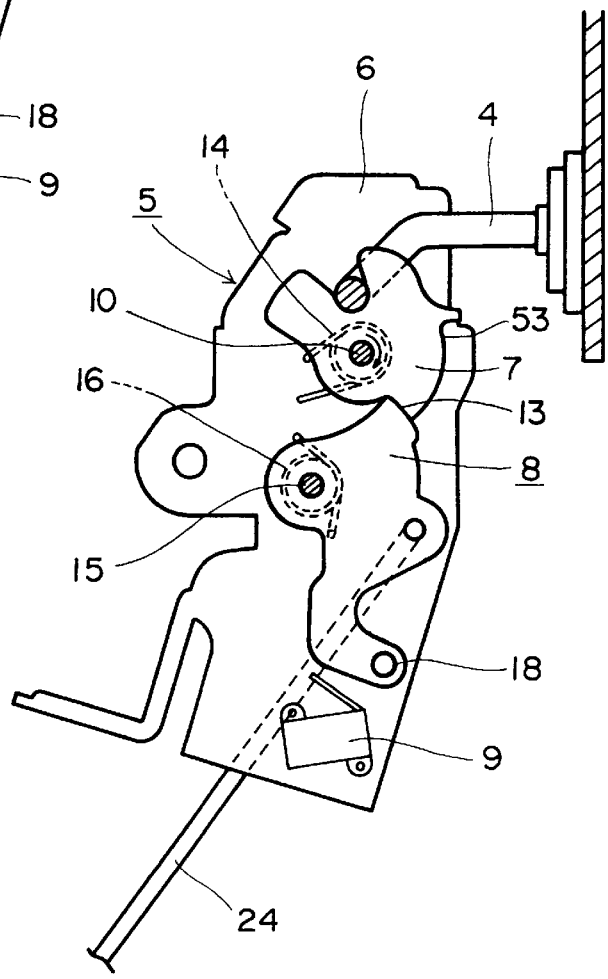
FIG. 4

LATCH DEVICE FOR A TAILGATE OF A VEHICLE

BACKGROUND OF THE INVENTION

1. Field of the Invention

The present invention relates to a latch device for a tailgate of a vehicle.

2. Description of the Related Art

Japanese Patent Publication No. 5-45753 describes a latch device arrangement used in a vehicle tailgate having an upper door and a lower door which are respectively rotatably attached to the rear surface of a vehicle body. The latch device arrangement comprises: a lower striker fixed to the vehicle body (A); a lower latch assembly (E) attached to the lower door (D) for holding the lower door (D) in a door-closed position by engaging with the lower striker; an upper striker (54) fixed to the upper door (C); an upper latch assembly (F) attached to the lower door (D) for holding the upper door (C) in a door-closed position by engaging with the upper striker (54); an open handle assembly (30) attached to the lower door (D) and operatively connected to the lower latch assembly (E) for releasing an engagement between the lower latch assembly (E) and the lower striker to open the lower door (D) when operated; opening means (36) attached to the lower door (D) and operatively connected to the upper latch assembly (F) for releasing an engagement between the upper latch assembly (F) and the upper striker (54) to open the upper door (D) when operated; and a coupling mechanism (H) displaceable between a locked position for disabling a door opening operation of the open handle assembly (30) and an unlocked position for enabling the door opening operation of the open handle assembly (30). The upper latch assembly (F) has a latch (64) which is displaceable between a door-closed position for engaging with the upper striker (54) and a door-open position for disengaging from the upper striker (54), and a ratchet (66) which is displaceable between an engaging position for engaging with the latch (64) located in the door-closed position so as to hold an engagement between the latch (64) and the upper striker (54) and an initial position for making contact with the latch (64) located in the door-open position. The coupling mechanism (H) is displaced to the locked position when the upper door C) is closed and displaced to the unlocked position when the upper door (C) is opened.

A first disadvantage of the prior art device is in that detecting means for detecting the position of the upper door (C) is complex. That is, the prior art detecting means is composed of a sliding member (90) which is slid by engaging with a base plate (56A) of the upper striker (54) when the upper door (C) is closed, and a rotating lever (24) which displaces the coupling mechanism (H) to the locked position when rotated by the movement of the sliding member (90). Further, if the mounting positions of the three members (54), (56A) and (90) are not accurate, it becomes difficult to accurately detect the position of the upper door (C).

Moreover, since the coupling mechanism (H) of the prior art device is attached to a bracket (12) which is fixed to the lower door (D), the connection of the coupling mechanism (H) and the open handle assembly (30) is troublesome. Furthermore, since the coupling mechanism (H) has a lever (10) which is supported by a longitudinal shaft (12A) and a lever (23) which is supported by a lateral shaft (21), it becomes large in both longitudinal and lateral directions.

SUMMARY OF THE INVENTION

Therefore, an object of the present invention is to provide a latch device for a tailgate of a vehicle, which has a simple structure and a high reliability.

It is another object of the present invention to provide a latch device equipped with a small-sized coupling mechanism.

It is further object of the present invention to provide a latch device in which the coupling mechanism is attached to an open handle assembly so that the assembly operations may be simplified.

BRIEF DESCRIPTION OF THE DRAWINGS

FIG. 3 is a side view showing an upper latch assembly in a door-open state;

FIG. 4 is a side view showing the upper latch assembly in a door-closed state;

DESCRIPTION OF THE PREFERRED EMBODIMENT

Figure 1:
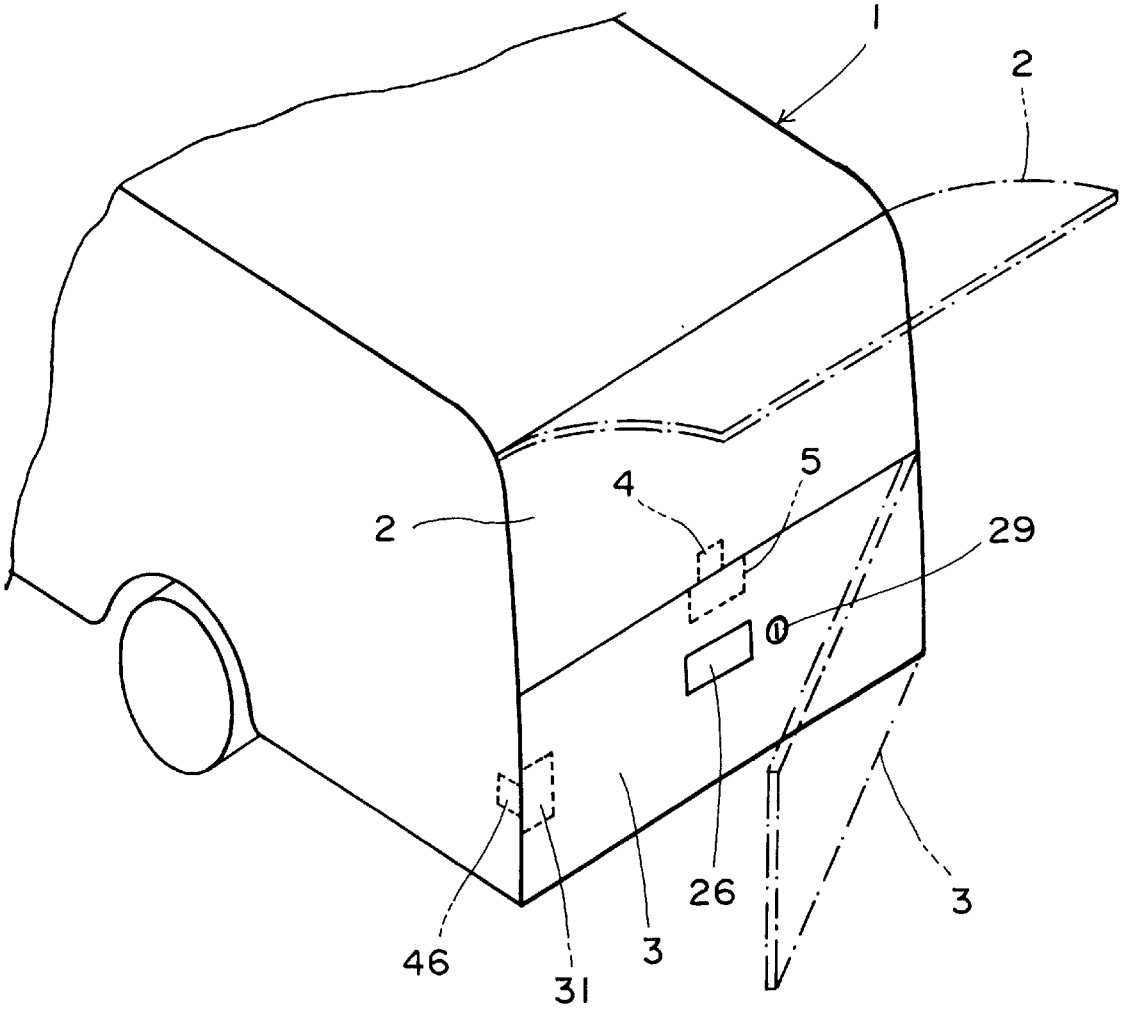
FIG. 1 is a perspective view showing a rear surface of a vehicle having a tailgate equipped with a latch device according to the present invention.

As shown in FIG. 1, a tailgate of a vehicle comprises an upper door 2 having an upper end portion which is rotatably attached to a vehicle body 1 and a lower door 3 having a side portion which is rotatably attached to the vehicle body 1. The lower door 3 has a lower latch assembly 31 at the other side thereof which holds the lower door 3 in a door-closed position by engaging with a lower striker 46 fixed to the vehicle body 1, and an upper latch assembly 5 at an upper side thereof which holds the upper door 2 in a door-closed position by engaging with an upper striker 4 fixed to the upper door 2. The lower door 3 further has an open handle assembly 26 for releasing the engagement between the lower latch assembly 31 and the lower striker 46 so as to open the lower door 3, and a key cylinder 29 for releasing the engagement between the upper latch assembly 5 and the upper striker 4 so as to open the upper door 2.

As shown in FIGS. 3 and 4, the upper latch assembly 5 comprises a latch 7 which is engageable with the upper striker 4, and a ratchet 8 which holds the engagement between the latch 7 and the striker 4 by engaging with the latch 7. The latch 7 is rotatably attached to a metal frame 6 by a latch shaft 10, and is urged in the clockwise direction by a resilient force of a spring 14. Thus, the latch 7 is held in a door-open position shown in FIG. 3 when the upper door 2 is opened. The ratchet 8 is rotatably attached to the metal frame 6 by a ratchet shaft 15, and is urged in the counter-clockwise direction by a spring 16. Thus, the ratchet 8 is brought into contact with a peripheral surface 53 of the latch 7 and is held in an initial position as shown in FIG. 3 when the upper door 2 is opened. When the upper door 2 is moved to close, the upper striker 4 enters a U-shaped groove 11 on the latch 7 and turns the latch 7 in the counterclockwise direction against the resilient force of the spring 14, and then the latch 7 is turned to a door-closed position as shown in FIG. 4 and the ratchet 8 moves, due to the resilient force of the spring 16, to an engaging position as shown in FIG. 4 in which the ratchet 8 is engaged with a step portion 13 on the latch 7, thereby the upper door 2 is completely closed and held in the door-closed position.

A switch 9 for detecting the door-open position of the upper door 2 is provided to the latch assembly 5, if desired. The switch 9 is pressed to be ON by a pin 18 attached to a leg portion 17 of the ratchet 8 when the ratchet 8 is in the initial position, i.e. the upper door 2 is in the door-open position. The switch 9 is used for the control of a room lamp of the vehicle or the control of an indicator of the driver seat.

The lower latch assembly 31 is arranged approximately similar to the upper latch assembly 5, and has a latch 47 which is engageable with the lower striker 46 and a ratchet 48 which holds the engagement between the latch 47 and the lower striker 46 by engaging with the latch 47.

In an inner space of the lower door 3, a connecting lever 21 having first to third arms 23, 25, and 28 is provided. The connecting lever 21 is attached to a frame 20 fixed to the lower door 3 by a shaft 22. The first arm 23 is connected to the ratchet 8 through a rod 24, and the second arm 25 is connected to the open handle assembly 26 through a rod 27, and the third arm 28 is connected to a key lever 52 of the key cylinder 29 through a rod 30. Since the connecting lever 21 is connected to the ratchet 8 through the rod 24 without a lost-motion, the connecting lever 21 is held in a door-closed position shown in FIG. 5 when the ratchet 8 is in the engaging position, and is held in a door-open position shown in FIG. 6 when the ratchet 8 is in the initial position. The connecting lever 21 is urged in the clockwise direction in FIG. 5 by a resilient force of a spring 19.

The key cylinder 29 of the present invention is formed into a push-type key cylinder. The push-type key cylinder 29 is displaceable between a locked state and an unlocked state by turning a key plate inserted into a key way. In the unlocked state, when a button (not shown in the figure) of the key cylinder 29 is pressed, the key lever 52 is rotated, but in the locked state, the operation of the button is impossible. When the key lever 52 is rotated by the operation of the button, the connecting lever 21 is turned in the counterclockwise direction in FIG. 2 through the rod 30 to move the rod 24 downward in FIG. 4, and the ratchet 8 is then turned in the clockwise direction against the resilient force of the spring 16 and is separated from the step portion 13 of the latch 7, thereby the upper door 2 is opened. After the upper door 2 is opened, the ratchet 8 is brought into contact with the peripheral surface 53 of the latch 7 and is held in the initial position as shown in FIG. 3, whereby the connecting lever 21 which is connected to the ratchet 8 through the rod 24 without a lost-motion is held in the door-open position shown in FIG. 6.

Figure 2:
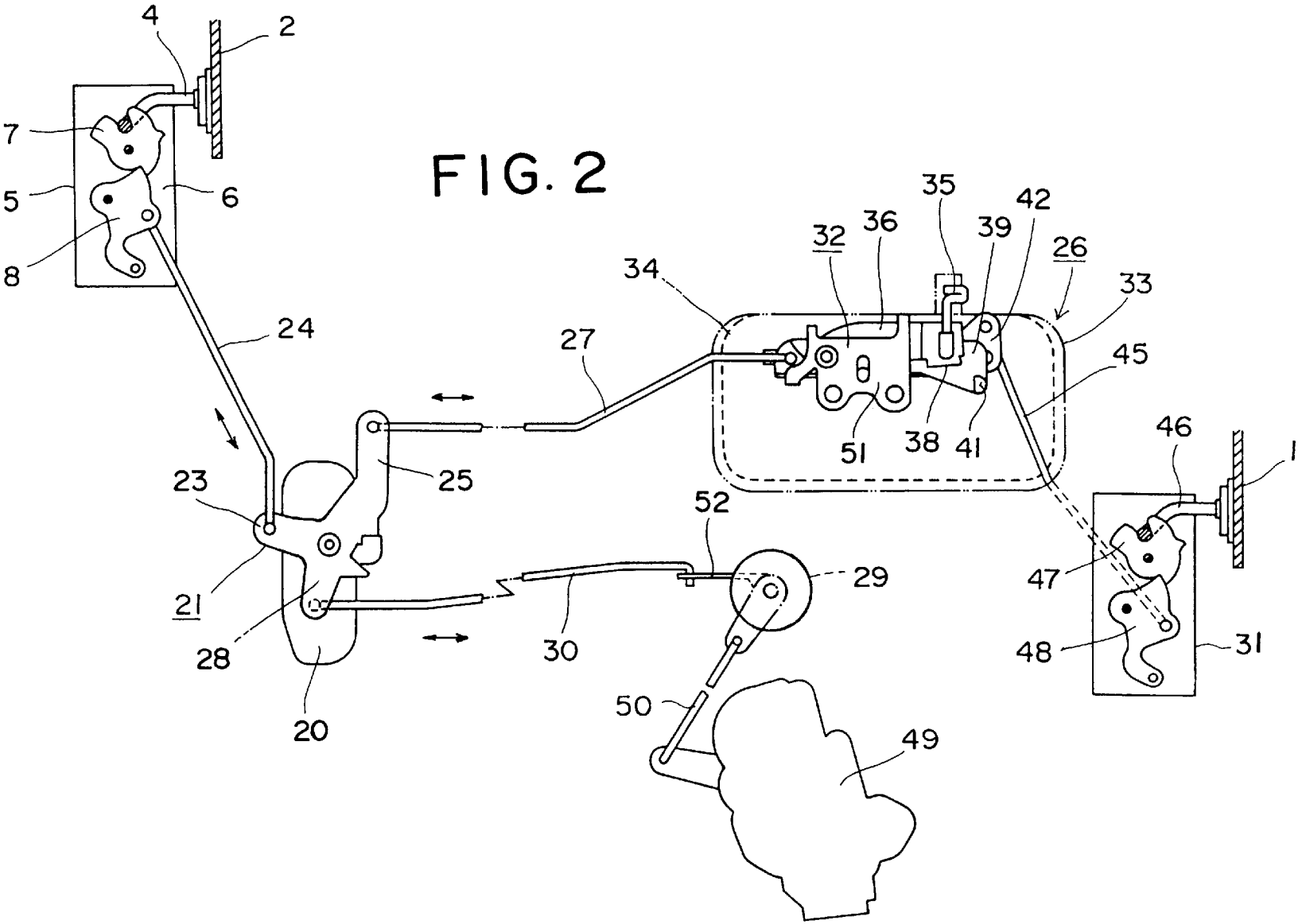
FIG. 2 is a schematic view showing the connecting relationship of parts of the latch device.

As shown in FIG. 2, the open handle assembly 26 has a handle case 33 fixed to a outer panel 54 of the lower door 3 and a handle lever 34 rotatably attached to the handle case 33. A coupling mechanism 32 is provided between the handle case 33 and a bracket 51 fixed to a rear surface of the handle case 33.

Figure 7:
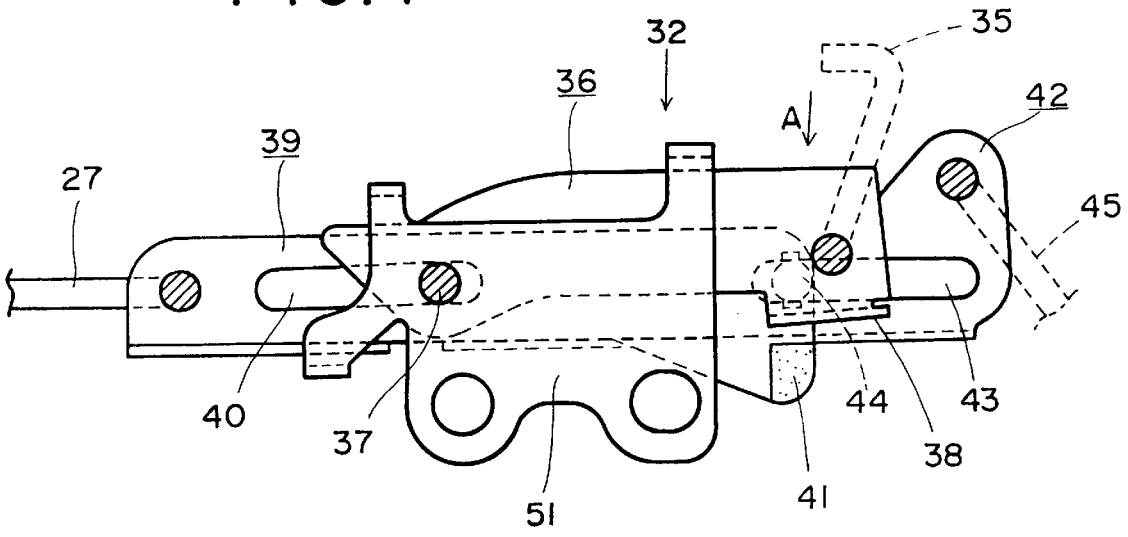
FIG. 7 is a back view showing a coupling mechanism in the door-open state (unlocked state)

The coupling mechanism 32 has, as shown in FIG. 7, an open lever 36 rotatably attached to a supporting shaft 37 fixed to the handle case 33, a locking link 39 having one end portion connected to the rod 27, and a ratchet lever 42 connected to the ratchet 48 of the lower latch assembly 31 through a rod 45. All of the open lever 36, the locking link 39, and the ratchet lever 42 are formed to be long in the horizontal direction and they are arranged overlapping one another.

The open lever 36 is connected to the handle lever 34 through a rod 35 so that the open lever 36 turns around the supporting shaft 37 in a direction of arrow A when an opening operation of the handle lever 34 is performed. A substantially horizontal engaging surface 38 is formed on a lower surface of the tip end of the open lever 36.

Figure 8:
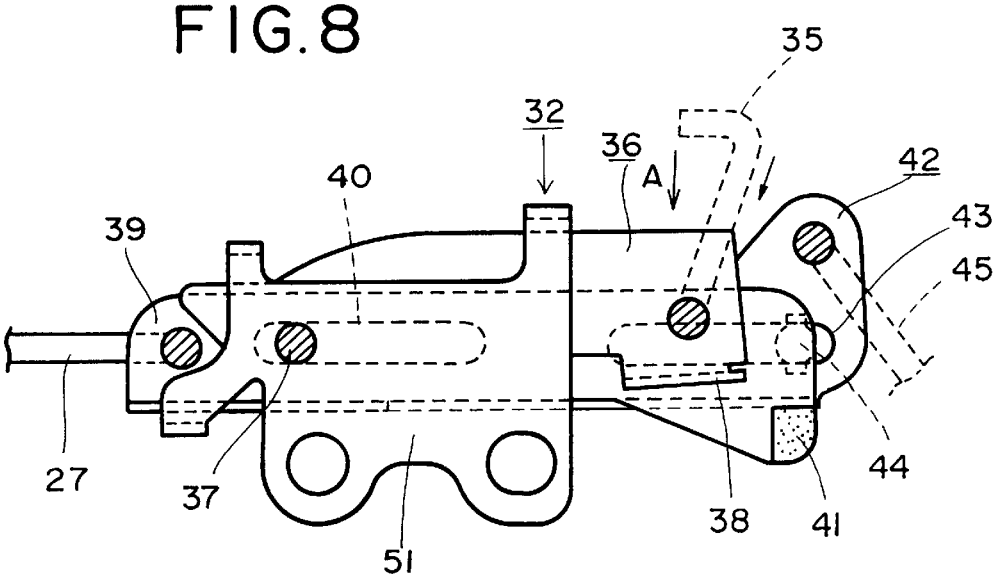
FIG. 8 is a back view showing the coupling mechanism in the door-closed state (locked state)
Figure 9:
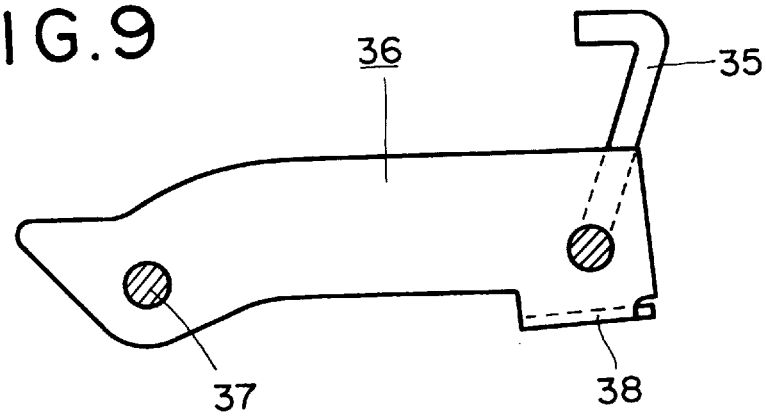
FIG. 9 is a back view of an open lever of the coupling mechanism.
Figure 10:
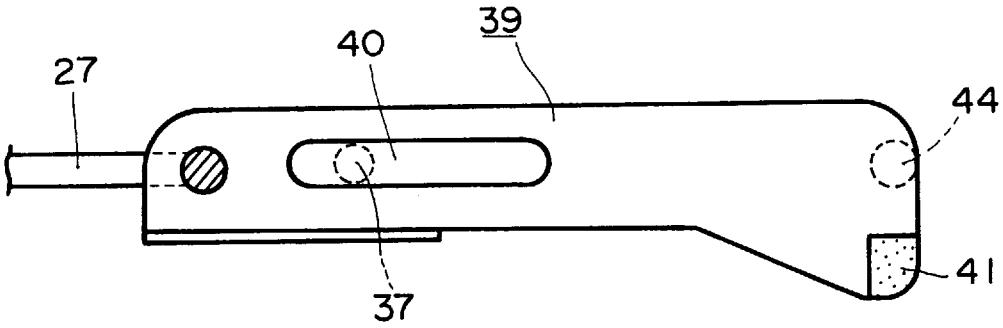
FIG. 10 is a back view of a locking link of the coupling mechanism.
Figure 11:
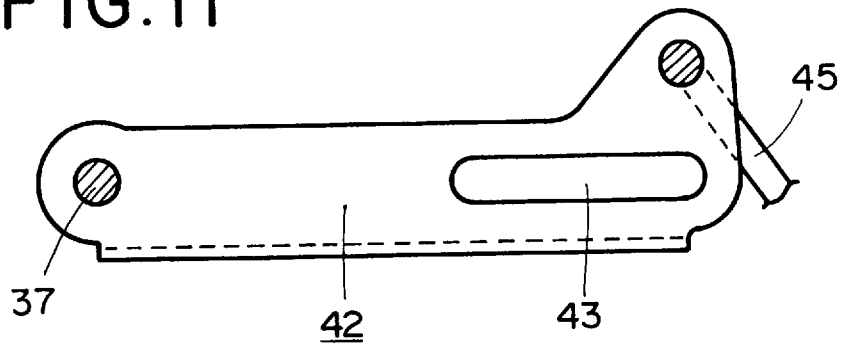
FIG. 11 is a back view of a ratchet lever of the coupling mechanism.

To the right end of the locking link 39, a projection 41 is provided. The locking link 39 has a horizontal elongated slot 40 into which the supporting shaft 37 is inserted so that the locking link 39 can be slid in the horizontal direction according to the positions of the connecting lever 21. When the upper door 2 is in the open position, that is, when the connecting lever 21 is in the door-open position, the locking link 39 is pulled leftward by the rod 27 to move to an unlocked position as shown in FIG. 7, thereby the projection 41 of the locking link 39 faces the engaging surface 38 of the open lever 36. Therefore, when the open lever 36 is rotated in the direction of the arrow A while the locking link 39 is in the unlocked position, the locking link 39 is rotated around the supporting shaft 37 in the direction of the arrow A due to the engagement between the projection 41 and the surface 38. To the contrary, when the upper door 2 is in the closed position, that is, when the connecting lever 21 is in the door-closed position, the locking link 39 is pushed rightward by the rod 27 to move to a locked position as shown in FIG. 8, thereby the projection 41 is separated from the engaging surface 38 of the open lever 36. Therefore, even if the open lever 36 is rotated in the direction of the arrow A while the locking link 39 is in the locked position, the projection 41 cannot engage with the surface 38, and accordingly the locking link 39 cannot rotate.

The ratchet lever 42 is rotatably attached to the supporting shaft 37, and has a horizontal elongated slot 43 into which a pin 44 of the locking link 39 is inserted. The ratchet lever 42 turns in the direction of the arrow A around the supporting shaft 37 by the connection between the pin 44 and the elongated slot 43 when the locking link 39 turns in the direction of the arrow A. The rotational movement of the ratchet lever 42 is transmitted through the rod 45 to the ratchet 48 of the lower latch assembly 31 to release the ratchet 38 from the latch 47, thereby the lower door 3 is opened. Thus, in the present invention, when the upper door 2 is opened, the locking link 39 is displaced into the unlocked position and the lower door 3 can be opened by the door opening operation of the handle lever 34. However, when the upper door 2 is closed, the locking link 39 is displaced into the locked position and it is impossible to open the lower door 3 by the door opening operation of the handle lever 34.

To the key lever 52, if desired, a remote-controlled motorized actuator 49 is connected so that the connecting lever 21 may be turned by the power of the motor.

Operation

Figure 5:
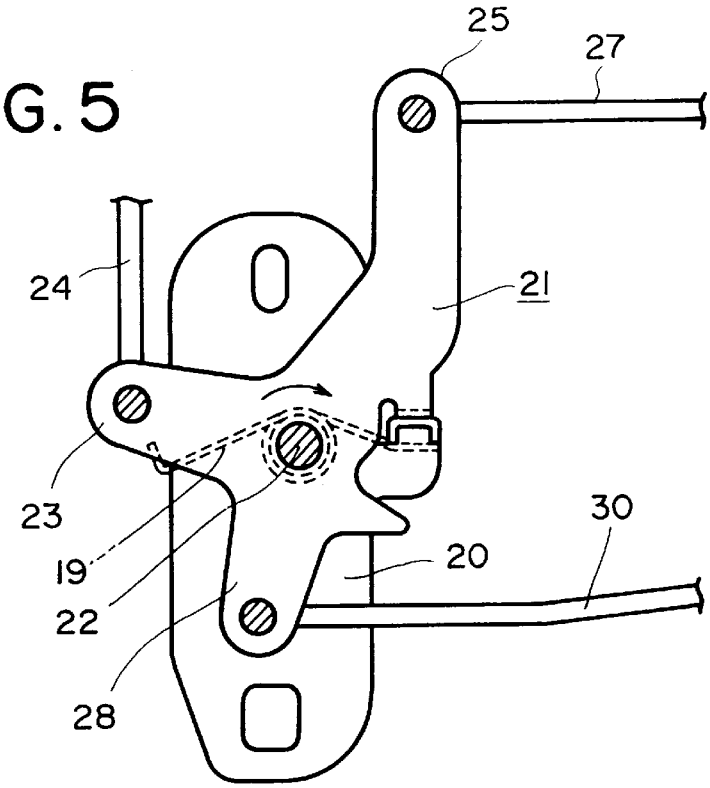
FIG. 5 is a side view showing a connecting lever in the door-closed state.
Figure 6:
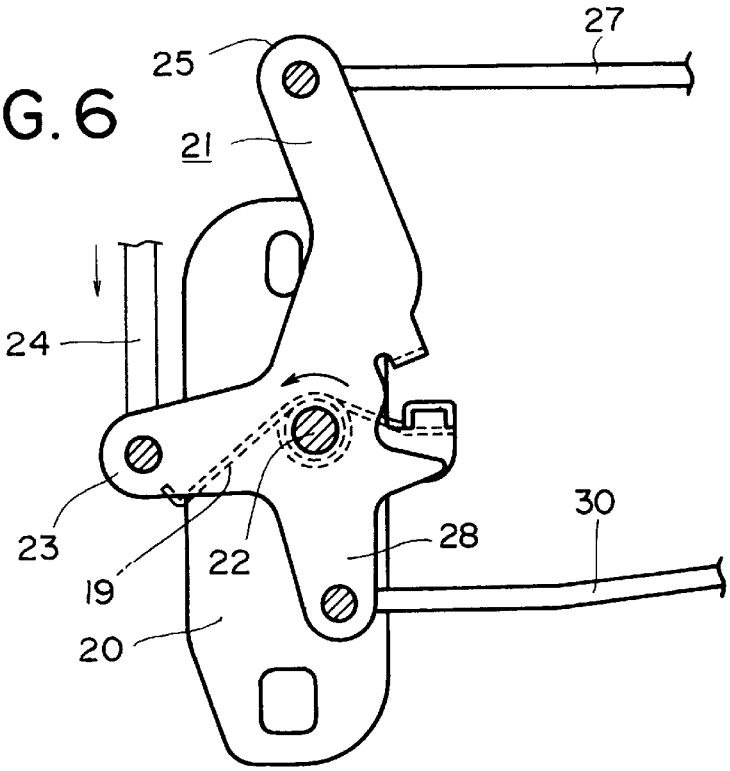
FIG. 6 is a side view showing the connecting lever in the door-open state.

When the button of the key cylinder 29 is pressed to turn the key lever 52 while the upper and lower doors 2, 3 are closed, the connecting lever 21 is displaced from the door-closed position in FIG. 5 to the door-open position in FIG. 6 against the resilient force of the spring 19 to move the rod 24 downward, the ratchet 8 is then rotated in the clockwise direction in FIG. 4 and is released from the latch 7, thereby the upper door 2 is opened. At the same time, the rod 27 is pulled leftward by the rotation of the connecting lever 21, then the locking link 39 is displaced into the unlocked position as shown in FIG. 7.

As the upper door 2 is in the open position as shown in FIG. 3, the ratchet 8 is brought into contact with the peripheral surface 53 of the latch 7 and is held in the initial position. Therefore the connecting lever 21 which is connected to the ratchet 8 by the rod 24 is held in door-open position, and accordingly the locking link 39 is held in the unlocked position.

In a case where the locking link 39 is in the unlocked position, when opening operation of the handle lever 34 is performed, the open lever 36 is rotated about the supporting shaft 37 in the clockwise direction through the rod 35 in FIG. 7, and then the engaging surface 38 of the open lever 36 comes into contact with the projection 41 to turn the locking link 39 about the supporting shaft 37 in the clockwise direction, thereby the ratchet lever 42 is turned about the supporting shaft 37 in the clockwise direction to push the rod 47 due to the connection between the pin 44 of the locking link 39 and the elongated slot 43, whereby the ratchet 48 of the lower latch assembly 31 is separated from the latch 47 so as to open the lower door 3.

In a case where both the upper and lower doors 2, 3 are opened, the lower door 3 should be first closed and then the upper door 2 is closed. When the upper door 2 is moved to close, the striker 4 enters the U-shaped groove 11 of the latch 7 to turn the latch 7 against the resilient force of the spring 14 in the counterclockwise direction, and then the latch 7 is turned to the door-closed position shown in FIG. 4, and the ratchet 8 moves, due to the resilient force of the spring 16, to the engaging position as shown in FIG. 4 in which the ratchet 8 is engaged with the step portion 13 on the latch 7, thereby the upper door 2 is completely closed and held in the door-closed position.

When the upper door 2 is closed, the rod 24 which is connected to the ratchet 8 is pulled upward according to the engaging position of the ratchet 8, and the connecting lever 21 is then displaced from the door-open position in FIG. 6 to the door-closed position in FIG. 5. Consequently, the rod 27 is pulled leftward due to the displacement of the connecting lever 21 to move the locking link 39 in the locked position in FIG. 8. In this state, even if the open lever 36 is turned due to the opening operation of the handle lever 34, the locking link 39 is not turned because the engaging surface 38 is not opposed to the projection 41, and accordingly the lower door 3 cannot be opened.

As mentioned above, in the present invention, since the locking link 39 is displaced to the locked position or unlocked position according to the position of the ratchet 8, the locking link 39 can be shifted accurately according to the opening or the closing of the upper door 2. Further, the mechanism for detecting the opening and the closing of the upper door 2 also becomes simpler. Moreover, since the coupling mechanism 32 is arranged to be attached to the rear surface of the handle case 33 of the open handle assembly 26, the coupling mechanism 32 and the open handle assembly 26 can be attached to the lower door 3 after previously being assembled, and therefore, the assembly operations become easy. Furthermore, since each of the members 36, 39, and 42 of the coupling mechanism 32 is supported by one supporting shaft 37, the thickness can be made to be thin.

What is claimed is:

1. A latch device arrangement on a vehicle tailgate having upper and lower doors which are respectively rotatably attached to a rear surface of a vehicle body, comprising:

a lower striker fixed to the vehicle body;

a lower latch assembly attached to the lower door for holding the lower door in a door-closed position by engaging with the lower striker;

an upper striker fixed to the upper door;

an upper latch assembly attached to the lower door for holding the upper door in a door-closed position by engaging with the upper striker;

an open handle assembly having a handle case attached to the lower door, and a handle lever rotatably attached to the handle case and operatively connected to the lower latch assembly for releasing an engagement between the lower latch assembly and the lower striker to open the lower door when operated;

a door key cylinder attached to the lower door and operatively connected to the upper latch assembly for releasing an engagement between the upper latch assembly and the upper striker to open the upper door when operated, said door key cylinder being operable without rotating the handle lever;

a coupling mechanism provided between the handle lever and the lower latch assembly, and having a locking link displaceable between an unlocked position in which an opening rotation of the handle lever is transmitted to the lower latch assembly so as to open the lower door and a locked position in which the opening rotation of the handle lever is not transmitted to the lower latch assembly;

said upper latch assembly having a latch which is displaceable between a door-closed position for engaging with the upper striker and a door-open position for disengaging from the upper striker, and a ratchet which is displaceable between an engaging position for engaging with the latch located in the door-closed position so as to hold an engagement between the latch and the upper striker and an initial position for making contact with the latch located in the door-open position;

said locking link being operatively connected to the ratchet such that the locking link is displaced to the locked position when the ratchet is displaced to the engaging position and that the locking link is displaced to the unlocked position when the ratchet is displaced to the initial position;

a connecting lever attached to the lower door and having a first arm, a second arm, and a third arm; and wherein said first arm is connected to the ratchet of the upper latch assembly through first connecting means, and said second arm is connected to the locking link through second connecting means, and said third arm is connected to the door key cylinder through third connecting means;

wherein said locking link and said ratchet of the upper latch assembly are mechanically connected with each other by way of the connecting lever with no substantial lost-motion.

2. A latch device arrangement according to claim 1, wherein said coupling mechanism and said ratchet are connected with each other by a rod.

3. A latch device arrangement according to claim 1, wherein said open handle assembly has a handle case fixed to the lower door and a handle lever rotatably attached to the handle case, and the coupling mechanism is attached to a rear side of the handle case.

4. A latch device arrangement according to claim 1, further comprising a connecting lever attached to the lower door and having a first arm, a second arm, and a third arm, wherein said first arm is connected to the ratchet through first connecting means, and said second arm is connected to the coupling mechanism through second connecting means, and said third arm is connected to the opening means through third connecting means.

5. The latch device arrangement according to claim 1, wherein said locking link is displaceably supported by the handle case at a rear side of the handle case.

6. A latch device arrangement on a vehicle tailgate having upper and lower doors which are respectively rotatably attached to a rear surface of a vehicle body, comprising:

a lower striker fixed to the vehicle to the body;

an lower latch assembly attached to the lower body for holding the lower door in a door-closed position by engaging with the lower striker;

an upper striker fixed to the upper door;

an upper latch assembly attached to the lower door for holding the upper door in a door-closed position by engaging with the upper striker;

an open handle assembly attached to the lower door and operatively connected to the lower assembly for releasing an engagement between the lower latch assembly and the lower striker to open the lower door when operated;

opening means attached to the lower door and operatively connected to the upper latch assembly for releasing an engagement between the upper latch assembly and the upper striker to open the upper door when operated;

a coupling mechanism displaceable between a locked position for disabling a door opening operation of the open handle assembly and an unlocked position for enabling the door opening operation of the open handle assembly; and said upper latch assembly having a latch which is displaceable between a door-closed position for engaging with the upper striker and door-open position for disengaging from the upper striker, and a ratchet which is displaceable between an engaging position for engaging with the latch located in the door-closed position so as to hold an engagement between the latch and the upper striker and an initial position for making contact with the latch located in the door-open position;

wherein said coupling mechanism is operatively connected to the ratchet such that the coupling mechanism is displaced to the locked position when the ratchet is displaced to the engaging position and that the coupling mechanism is displaced to the unlocked position when the ratchet is displaced to the initial position;

wherein said open handle assembly comprises a handle case fixed to the lower door, a handle lever rotatably attached to the handle case, and a supporting shaft attached to the handle case, said coupling mechanism comprises an open lever connected to the handle lever and rotated by an opening operation of the handle lever, a ratchet lever connected to the lower latch assembly, and a locking link connected to the ratchet and displaceable between a locked position in which a rotation of the open lever is not transmitted to the ratchet lever and an unlocked position in which the rotation of the open lever is transmitted to the ratchet lever, and said open lever, said ratchet lever and said locking link are rotatably mounted on the supporting shaft.

7. A latch device arrangement on a vehicle tailgate having upper and lower doors which are respectively rotatably attached to a rear surface of a vehicle body, comprising:

a lower striker fixed to the vehicle body;

a lower latch assembly attached to the lower door for holding the lower door in a door-closed position by engaging with the lower striker;

an upper striker fixed to the upper door;

an upper latch assembly attached to the lower door for holding the upper door in a door-closed position by engaging with upper striker;

an open handle assembly attached to the lower door and operatively connected to the lower latch assembly for releasing an engagement between the lower latch assembly and the lower striker to open the lower door when operated;

opening means attached to the lower door and operatively connected to the upper latch assembly for releasing an engagement between the upper latch assembly and the upper striker to open the upper door when operated;

a coupling mechanism displaceable between a locked position for disabling a door opening operation of the open handle assembly and an unlocked position for enabling the door opening operation of the open handle assembly; and said open handle assembly having a handle case fixed to the lower door and a handle lever rotatably attached to the handle case;

wherein said coupling mechanism is attached to a rear side of the handle case;

wherein said handle case has a supporting shaft, said coupling mechanism comprises an open lever connected to the handle lever and rotated by an opening operation of the handle lever, a ratchet lever connected to the lower latch assembly, and a locking link connected to the ratchet and displaceable between a locked position in which a rotation of the open lever is not transmitted to the ratchet lever and an unlocked position in which the rotation of the open lever is transmitted to the ratchet lever, and said open lever, said ratchet lever and said locking link are rotatably mounted on the supporting shaft.

* * * * *

UNITED STATES PATENT AND TRADEMARK OFFICE

CERTIFICATE OF CORRECTION

PATENT NO. : 6,017,067

DATED : Jan. 25, 2000

INVENTOR(S) : Yoneyama et al.

It is certified that error appears in the above-identified patent and that said Letters Patent is hereby corrected as shown below:

Column 6, lines 62-67 and Column 7, lines 1-10 (claims 2-4), delete entirely.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*